United States Patent [19]

Martin

[11] Patent Number: 4,630,057

[45] Date of Patent: Dec. 16, 1986

[54] VEHICLE LOCATION SYSTEM

[75] Inventor: David J. R. Martin, Leatherhead, England

[73] Assignee: Coal Industry (Patents) Limited, London, England

[21] Appl. No.: 654,083

[22] Filed: Sep. 25, 1984

[51] Int. Cl.[4] ..... H04R 7/185; B66B 3/02

[52] U.S. Cl. ..... 342/358; 340/21; 455/55; 342/365

[58] Field of Search ..... 343/453, 457, 458, 464, 343/465; 340/21, 686; 455/55, 7, 9, 10

[56] References Cited

U.S. PATENT DOCUMENTS

| | | | |
|---|---|---|---|
| 2,859,426 | 11/1958 | Davis | 343/457 |
| 3,199,630 | 8/1965 | Engel et al. | 340/21 |
| 3,406,342 | 10/1968 | Hübner | 455/9 |
| 3,916,311 | 10/1975 | Martin et al. | 455/55 |
| 4,041,495 | 8/1977 | Martin | 343/465 |
| 4,233,588 | 11/1980 | Satoh | 343/458 |
| 4,495,495 | 1/1985 | Ormanno et al. | 455/7 |

*Primary Examiner*—Theodore M. Blum
*Assistant Examiner*—David Cain
*Attorney, Agent, or Firm*—James C. Wray

[57] ABSTRACT

A leaky-feeder or other form of guided radiocommunication system serving a linear route or track is equipped at intervals with static marker devices which successively modify a radio signal passing those points between a fixed base station and a personal or mobile station travelling the route. By reference to the resulting overall modification to the signal as received at the mobile or fixed station the position of the mobile station may be determined or delimited.

20 Claims, 3 Drawing Figures

VEHICLE LOCATION SYSTEM

BACKGROUND OF THE INVENTION

The object of this invention is to provide a means of establishing the position of a vehicle or person moving along a defined track or route and in communication with a fixed point through a radiocommunication system in which the propagation means of the radio signals is guidance by the walls of a tunnel containing the route or track or by a leaky feeder (sometimes called a radiating cable) which follows the same track or route or runs closely parallel to it.

Previously, arrangements have been used or proposed for such purpose whereby the position of the vehicle or person has been determined by an adaptation of normal radar principles in which the elapsed time between an interrogating signal and its response or echo is taken as a measure of the distance involved. Another arrangement, described in the British Pat. No. 1,480,779 and in U.S. Pat. No. 4,041,495, established the position of a vehicle or moving machine by a comparison of the respective phases of a radio signal transmitted from the vehicle or machine and received at the two ends of its track. Such arrangements are difficult to engineer and impose serious constraints on the type and characteristics of any repeaters or amplifiers such as are usually necessary in a system when a leaky feeder is employed as the propagation means over distances of several kilometers or more.

Other arrangements employ short-range wayside radio beacons with associated receivers on the vehicles, or alternatively such beacons on the trains with associated receivers by the wayside, and update stored information relating to the position of the vehicle whenever the train passes the beacon or receiver. Such arrangements are expensive if close accuracy and thus close spacing of the beacons or receivers is required, and also still require a radiocommunication channel if the information is to be relayed between the train and a fixed point. Another disadvantage is that if the stored information is lost through a system fault or power failure it cannot be restored until the vehicle passes a beacon or receiver.

SUMMARY OF THE INVENTION

The present invention overcomes these disadvantages of previous systems. It is particularly suited to mines and tunnels and other such types of environment in which radio signals of the frequency used in the communication are not well propagated according to the normal natural laws which operate in free-space conditions on or above the surface of the earth but are propagated artificially by means of a leaky feeder (or radiating cable) which may or may not contain amplifiers to restore the signal level periodically against losses. An esential requirement of the propagation medium in this invention is that it should allow the signal being transmitted to be intercepted and modified at designated points so allowing the number and identity of such points negotiated by the signal to be determined by the overall modification of the signal as received at or transmitted from the vehicle or person, thereby allowing the position of the vehicle or person to be deduced.

To a more limited degree the invention may also be applied in a form where the propagation means is guidance by a tunnel containing such track or route. It is a characteristic of such propagation that the attenuation of the signal is so high that the signal has to be regenerated at intervals, and especially at barriers to the propagation such as bends, corners or obstructions in the tunnel. It may then be arranged that the necessary interception and modification of the signal is carried out in the regeneration process at such points.

It will be appreciated that the invention may be applied in any situation where a radio signal between a fixed point and a mobile station is propagated by any means, other than natural free-space propagation, which allows the signal to be intercepted and modified at fixed points along the track of the mobile station.

A typical embodiment of the invention will now be descrbed in which a vehicle travels through a tunnel and the radiocommunication medium between the vehicle and a fixed point is a leaky feeder running through the tunnel.

It will be understood that a leaky feeder as used in this context is a well-known means of providing radio propagation in such environments, and comprises a radio-frequency transmission line which has been deliberately made to possess significant external leakage fields through which mobile stations may communicate with fixed stations or with one another; a common type of leaky feeder is a coaxial cable in which the braided outer conductor has been applied with a loose or open weave to allow the necessary leakage of radio-frequency fields, but other types are also used and are suitable for this application.

DETAILED DESCRIPTION OF THE DRAWINGS

Figure 1:
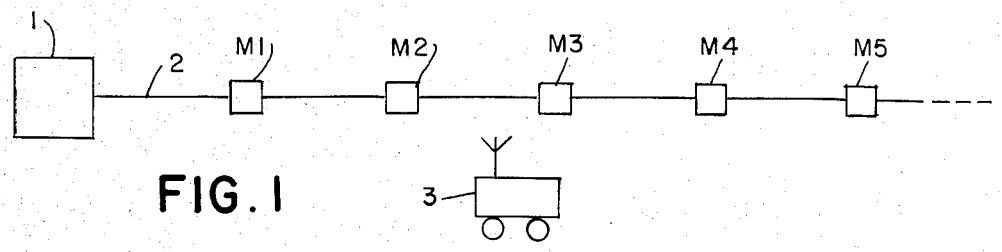
FIG. 1 is a schematic representation of a preferred embodiment of the invention.

The typical arrangement will be described by reference first to FIG. 1, where 1 is a fixed radio station connected to a leaky feeder 2 which runs through a tunnel parallel to the track of a mobile radio station carried by a vehicle or person 3. As so far described this arrangement is typical of a leaky-feeder system providing radio communication between the fixed radio station 1 and the mobile station 3, of which there may be any number.

To provide the further facility of position determination which is the object of this invention one or more marker devices are connected in series with the leaky feeder at suitable points M1, M2, M3, M4, M5 and so on as required and spaced according to the required resolution in the determination of position. Every such marker device is arranged to be able to detect any interruption between defined limits of duration in the radio-frequency signal transmitted by the fixed station 1 or any series of such interruptions and to introduce a further similar interruption at a defined interval following the received interruption or series of interruptions. For example, each marker may be designed to detect any interruption of signal of duration between 2 and 10 ms or any series of such interruptions and to introduce a further interruption of duration 5 ms at an interval of 100 ms after the last received interruption.

If, now, the fixed station is arranged to introduce into its own transmission a signle interruption of duration between the prescribed limits then the first marker device which receives the signal, M1, will add a further interruption following it at the prescribed interval. The second marker device, M2, will thus receive two such interruptions in succession and in similar manner will add a further interruption. Every such marker device will add its own interruption to the series, and so the signal received by the mobile station 3 will carry a number of interruptions depending on the number of marker devices the signal has had to negotiate to reach the mobile station.

In this simple case the total number of interruptions will be one more than the number of marker devices encountered in the transmission path; that is, if the sections of leaky feeder between the fixed station and the first marker device and between successive marker devices are numbered in sequence from the fixed station then the number of interruptions received will correspond to the number of the section in which the mobile station is located at the time. If necessary, this information may then be relayed to the fixed station over the normal return radiocommunication path.

It will be appreciated that the circuit technology involved in engineering such a system is simple and well known to those skilled in radio-frequency engineering and digital circuit techniques. However, it should be noted that it is preferable that the marker device is able to determine whether a particular interruption is the last in a series or not, without waiting to see if it is indeed followed; otherwise, it becomes necessary to increase successively the intervals between interruptions to allow for the tolerances that are necessary in a practical arrangement. Such immediate determination of the last interruption may be facilitated by arranging that the last interruption added by any marker is considerably shorter than its predecessors in order to distinguish it; its length may then be extended to normal by the subsequent marker in the process of determining that it is the last and of preparing to add a further interruption. Alternatively, the marker device can be arranged to count the incoming pulses and identify the last one from a knowledge of its own position in the chain of markers.

Figure 2:
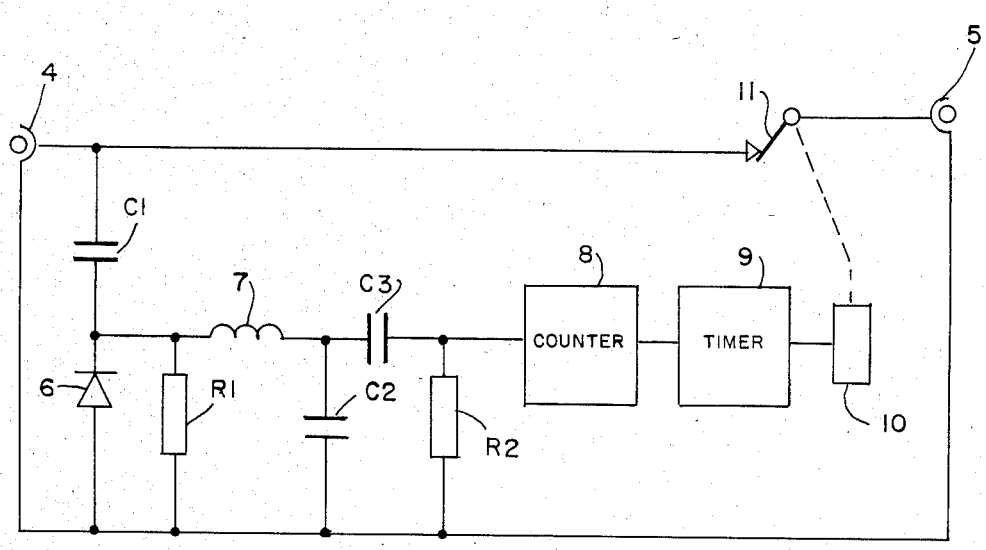
FIG. 2 is a wiring diagram of a preferred embodiment of the invention.

One typical form of marker device for this embodiment of the invention is shown in FIG. 2, where 4 is the connection to the incoming leaky feeder from the direction of the base station or preceding marker device and 5 is the connection to the outgoing leaky feeder and any further marker devices. The incoming radio-frequency signal in its normal steady state is rectified by the circuit comprising capacitor C1, diode 6, and resistor R1, and then smoothed by the circuit comprising radio-frequency choke 7 and capacitor C2 to produce a steady DC voltage across capacitor C2. Interruptions in the incoming signal cause corresponding interruptions in the DC potential across capacitor C2. The resulting pulses are passed through the differentiating circuit comprising capacitor C3 and resistor R2 to the standard counter circuit 8 which determines when the final pulse in a series has been received and thereupon passes a signal pulse to the standard timing circuit 9.

This in turn initiates the required further interruption in the outgoing signal path, setting its interval and duration. In FIG. 2 this interruption has for simplicity been shown as being effected by a mechanical relay coil 10 and associated contact 11. Such mechanical arrangement may in fact be used if the resulting limitation on speed of the process is acceptable, but for fast operation it is necessary to use solid-state switching techniques based on transistors, PIN diodes or other such devices and familiar to those skilled in the art.

In the typical arrangement shown in FIG. 2 it is assumed that the level of radio-frequency signal being propagated over the leaky feeder is adequate for direct demodulation into a correspondingly interrupted DC signal. However, in some applications this level may not be so adequate and will require the interposition of an amplifying circuit between the input connection 4 and the demodulating circuit represented here by the components C1, 6 and R1. Furthermore, there may be several radio-frequency signals being propagated over the leaky feeder at different carrier frequencies, not all of which may be carrying the interruptions or modifications for position determination. In such case, to avoid disturbing those signals not concerned with the position determination it may be desirable to arrange by normal tuning methods within each marker device that ony the intended signal is examined and further interrupted or modified.

In practice, leaky feeder systems of greater length than a kilometer or so normally employ repeaters or amplifiers at regular intervals in the system in order to compensate for line losses. Such repeaters do not impede in any way the operation of the invention as described, and may simplify the design of the marker devices by ensuring a more constant and higher signal level. Furthermore, they usually operate from a power supply fed over the leaky feeder itself, and this is then available also for powering the marker devices. In some cases it will be convenient to combine the marker devices with repeaters.

In case where the power supply for the operation of the marker devices is fed over the leaky feeder it will be noted that in the simple arrangement shown in FIG. 2 the relay contact 11 will also interrupt the power supply to subsequent marker devices in the same process as it interrupts the radio-frequency signal. Advantage may be taken of this feature by arranging that marker devices detect interruptions to the power supply rather than to the radio-frequency signal, with consequent simplification. To preserve uniformity between marker devices it then becomes necessary to arrange that the initial interruption of the signal at the base station is replaced by an interruption of the power supply line to the leaky feeder. In any arrangement where the power supply is fed over the leaky feeder and suffers interruption it also becomes necessary to provide capacitor or battery storage in each marker device to preserve a constant supply to the electronic circuits therein against the interruptions.

If the number of marker devices in a system becomes large, either because of the length of the system or because a high resolution of position is required, a disadvantage may arise in the resulting long series of interruptions taking an unacceptable time—perhaps several seconds—for the location process, especially if the frequency of interruptions is limited by considerations of bandwidth of the signal. In such case it is possible to carry out the location process in two stages with consequent reduction in the total number of interruptions involved.

For example, suppose a particular system requires the use of 99 marker devices. In the simple embodiment of the invention this would result finally in a series of 100 interruptions, to be counted by any vehicle in the final section. In an improved variation every tenth marker only will respond to a series of fewer than 10 interruptions and add a further interruption. Therefore, the number of interruptions received in a series will denote only the decade of sections in which the mobile station is. This information is then relayed to the fixed station which thereupon initiates a further series of interruptions. This initiation, however, consists of sending not a single interruption but a series of interruptions corresponding to the number 10 decremented by the number of interruptions previously received.

As before, every tenth marker will respond by incrementing the number of interruptions by one. But when the number of interruptions reaches 10 every subsequent marker will respond. This transition will occur when the previously determined decade is reached. Thus, the number of interruptions then received in excess of 10 will denote the number of the section within the decade, and so the section will have been determined absolutely. It will be appreciated that the precise implementation of this arrangement will depend on the mode of numbering of the sections, and in particular whether the first section is to be designated '0' or '1'.

In such an arrangement the precise section out of a total of 99 may be determined by two series of interruptions totalling not more than 20, although subsequent marker devices may continue to increment the series of interruptions up to a total of 110. This may be avoided by arranging that marker devices do not increment interruptions beyond a count of 20.

The principle of this two-stage arrangement may be extended to a multiplicity of stages to reduce still further the total number of interruptions involved in any determination of position. In the extreme, the sections will be divided on a binary basis, and in such case a particular section could be identified out of a total of 128, for example, using 7 initiations and a maximum of 13 interruptions in total.

Although the invention has so far been described by reference to signals being transmitted from the fixed station to a mobile station, it is to be understood that the principle is similarly effective with signals transmitted in the converse direction, from a mobile to a fixed station. Such converse arrangement may be advantageous if the mobile station is associated with a vehicle that would not otherwise require to be equipped with a radio receiver as well as a radio transmitter, for example in the case of an unmanned vehicle such as a mine car; it ca then be arranged that the transmitter on the vehicle initiates a single, simple series of interruptions at random, infrequent intervals. However, in such an arrangement it is not possible to arrange that the markers can identify the last interruption in a series by counting and other means must be used. It will also be appreciated that by the nature of a leaky-feeder system the signal levels relating to mobile transmissions in the feeder are at a considerably lower level than those related to fixed-station transmissions, and so additional complexity would be involved in the marker devices on that account.

Figure 3:
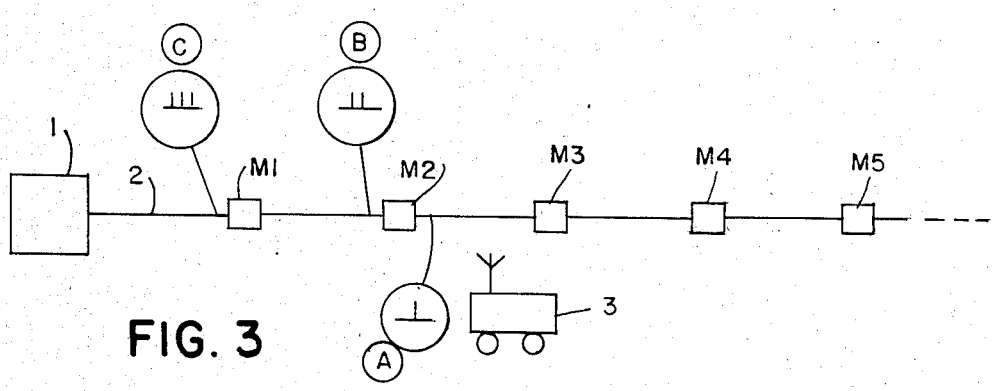
FIG. 3 is a schematic representation of another embodiment of the invention.

FIG. 3 illustrates a typical signal path and sequence of marking operations in such a case where the originating signal is transmitted by a mobile station and received by the fixed station. The signal as transmitted by the mobile station already carries a single marking, as at (A). The markers in the signal path between the mobile station and the fixed station, in this case markers M1 and M2, each add a further marking to the signal as at (B) and (C). The signal as received at the fixed station is thus as at (C), carrying three marks. From this information the fixed station deduces that the signal has in this example negotiated two markers, and thus the position of the mobile station is defined.

In all cases it is to be understood that any initiation of a series of interruptions, whether by a fixed or mobile station, may if appropriate be preceded by a coded preamble to identify the station whose position is to be determined.

In the particular arrangement described the modification of the signal by each marker device has been by successive complete interruptions of the carrier. However, it is to be understood that other methods of modifying the carrier or signal may be used, for example by shifting its phase or by a partial reduction only in amplitude. Preferably, any such successive modifications of the signal, in whatever manner, should be separate in the time domain, so as to be able to distinguish the modifications and count them. However, in the case of modifications effected to a signal by shifting its phase it is possible at additional complication to arrange that marker devices may remove, nullify or modify a modification that has been imparted to a signal by a preceding marker device, and in this way to confine the coding within a shorter overall interval of time.

The typical arrangement described also assumed that the means or medium of radio signal propagation is a leaky feeder which may or may not contain repeaters at intervals to restore the level against losses. It is also possible to apply the invention in cases where the signal is propagated in the form of a radio wave guided by the walls of a tunnel. In cases of such means of propagation it is necessary at intervals to introduce repeaters or relay stations to compensate for losses caused by corners, bends or obstructions in the tunnel or simply for the natural losses associated with such modes of propagation in a straight line. It may then be arranged that such repeaters modify the signal in similar fashion to the marker devices described for the case of leaky-feeder propagation. If necessary for the purpose of resolution of position indication such repeaters may be spaced at more frequent intervals than would be necessary simply for the purpose of compensating for propagation losses providing that the gain imparted to the signal by each such repeater is sufficient to ensure that the modified signal is subsequently substantially predominant over the unmodified incident signal.

I claim:

1. A radio location system comprising a fixed base radio station, a radio propagation guiding means following a linear route, mobile radio station means for travelling such linear route, static marker means included in the propagation guiding means and arranged to apply discrete and time-sequential modifications constituting individual interruptions to a radio signal being transmitted through the guiding means in such manner that the position of a mobile radio station may be determined by reference to the numer of such discrete time-sequential modifications thereby imparted to a radio signal transmitted between the fixed base station and the said mobile station.

2. A system as claimed in claim 1 in which the modification is imparted by the marker means to a radio signal transmitted from the fixed base station to a mobile station.

3. A system as claimed in claim 1 in which the modification is imparted by the market devices to a radio signal transmitted from a mobile station to the fixed base station.

4. A system as claimed in claim 1 in which the propagation guiding means is a leaky feeder.

5. A system as claimed in claim 1 in which the propagation guiding means is a tunnel containing the route being travelled and equipped at suitable static positions with repeaters which redirect and impart substantial gain to the signal, every marker device in such system being integral with such a repeater.

6. A system as claimed in claim 1 in which the modification imparted to the signal by a marker device consists of a short interruption in its transmission.

7. A system as claimed in claim 1 in which the determination of position of the mobile station is achieved in two or more stages by the transmission of two or more distinguishable signals in succession, the marker devices in such case being arranged to respond differentially according to type of marker device and to type of signal.

8. A location system comprising fixed base station means, mobile station means for travelling with respect to the fixed base station means along a route, signal propagation means for propagating a signal, guiding means for guiding the signal along the route, marker means positioned along the route for applying discrete modifications to the signal being guided through the guiding means, whereby positions of the mobile station means may be determined by reference to the discrete modifications imparted to the signal between the fixed base station means and the mobile station means.

9. A location as claimed in claim 1 in which the signal propagation means is radio signal propagation means for propagating a radio signal and wherein the marker means marks sequential modifications in the radio signal.

10. A location system as claimed in claim 9 wherein the radio signal propagation means is connected to the fixed base station means and wherein the guiding means guides the signal from the fixed base means along the route and wherein the marker means marks sequential modifications to the radio signal from the fixed base station means to the mobile station means.

11. The location of claim 9 wherein the radio signal propagation means is connected to the mobile station means and wherein the marker means marks sequential modifications to a radio signal transmitted from the mobile station means to the fixed based station along the guiding means.

12. A location system as claimed in claim 9 wherein the guiding means comprises leaky feeder guiding means.

13. A location system as claimed in claim 9 in which the guiding means is a tunnel containing a route along which mobile stations means travel and wherein the guiding means further comprises repeater means for redirecting the signal and imparting substantial gain to the signal and hwerein each marking means is in combination with a repeater means.

14. A location system as claimed in claim 8 wherein the marker means comprises means for interrupting the guiding of the signal.

15. A location system as claimed in claim 8 wherein the signal propagation means comprises means for propagating a power signal.

16. A system as claimed in claim 8 wherein the signal propagation means propagates more than one signal and wherein the marker means comprise means for responding differentially according to the type of marker means and the type of signal propagated by the signal propagation means.

17. A method for relatively locating a mobile station with respect to a fixed base station comprising propagating a signal along a route travelled by the mobile station, providing marker means along the route and marking the signal with the marker means as the signal is propagated along the route, receiving the marked signal and determining the position of the mobile station means according to markings in the signal.

18. The method of claim 17 wherein the propagating comprises propagating a radio signal and wherein the marking comprises interrupting the radio signal and wherein the determining comprises determining position according to interruptions in the radio signal.

19. The method of claim 17 wherein the signal includes a power signal and wherein the marking comprises interrupting the power of the power signal.

20. The method of claim 17 wherein the propgating the signal comprises propagating a signal from the base station and wherein the signal is received at the mobile station with the markings.

* * * * *